US005753423A

United States Patent [19]

Buongiorne et al.

[11] Patent Number: 5,753,423

[45] Date of Patent: May 19, 1998

[54] METHOD FOR PREPARING A READY-TO-USE PHOTOGRAPHIC BLEACHING SOLUTION

[75] Inventors: Jean Marie Buongiorne, Brockport; Stephen Joseph Waffle, Ontario; Richard Thomas Clark, Hamlin, all of N.Y.

[73] Assignee: Eastman Kodak Company, Rochester, N.Y.

[21] Appl. No.: 639,492

[22] Filed: Apr. 29, 1996

[51] Int. Cl.[6] ..... G03C 7/42

[52] U.S. Cl. ..... 430/461; 430/393; 430/460

[58] Field of Search ..... 430/460, 461, 430/393

[56] References Cited

U.S. PATENT DOCUMENTS

| | | | |
|---|---|---|---|
| 4,328,306 | 5/1982 | Idota et al. | 430/393 |
| 5,061,608 | 10/1991 | Foster et al. | 430/461 |
| 5,236,814 | 8/1993 | Kuse et al. | 430/393 |
| 5,352,568 | 10/1994 | Kuse et al. | 430/393 |
| 5,384,233 | 1/1995 | Kuse et al. | 430/430 |

FOREIGN PATENT DOCUMENTS

| | | | |
|---|---|---|---|
| 0 556 7872 A1 | 8/1993 | European Pat. Off. | G03C 7/42 |

*Primary Examiner*—Hoa Van Le
*Attorney, Agent, or Firm*—J. Lanny Tucker

[57] ABSTRACT

A ready-to-use bleaching or bleach-fixing solution can be prepared by mixing an aqueous solution of succinic acid, maleic acid or malic acid, and an aminopolycarboxylic acid ligand, adding a ferric salt to form a ferric ligand chelate, and adding a chemical base, such as ammonia, to provide a final pH of from 2.5 to 5.5. optionally, a portion of the chemical base can be added before the addition of the ferric salt.

20 Claims, No Drawings

METHOD FOR PREPARING A READY-TO-USE PHOTOGRAPHIC BLEACHING SOLUTION

FIELD OF THE INVENTION

This invention relates to a method for formulating a ready-to-use photographic bleaching solution, and to the bleaching solution prepared thereby.

BACKGROUND OF THE INVENTION

In the production of color photographic images, it is necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

A wide variety of bleaching agents are known for use in photographic processing, for example, ferricyanide, persulfates, dichromates, permanganates, ferric chloride and water-soluble quinones.

It is particularly well known to use a ferric complex of an aminopolycarboxylic acid as a bleaching agent in photographic color processing. Such complexes can be used in both bleaching and bleach-fixing compositions. A very large number of different complexing aminopolycarboxylic acids are known in the art, including the more common ethylenediaminetetraacetic acid (EDTA) and 1,3-propylenediaminetetraacetic acid (PDTA). Others as described, for example, in U.S. Pat. No. 5,061,608 (Foster et al) and U.S. Pat. No. 5,352,568 (Kuse et al), and in references cited therein.

Conventional bleaching solutions generally include one or more acids for buffering or prevention of unwanted dye formation. Such acids include acetic acid, succinic acid and propionic acid as described in U.S. Pat. No. 5,061,608 (noted above). Dozens of buffering organic carboxylic and phosphonic acids are described in U.S. Pat. No. 5,352,568 (noted above), with cyclic acids being taught as preferred.

While both references describe the presence of succinic acid and other acids in bleaching compositions, acetic acid is commonly used in the industry because it is inexpensive, highly water-soluble and provides easy bleach composition formulation. It is also known, however, that acetic acid has an unpleasant odor especially when it is used in large tanks in small rooms or poorly ventilated laboratories. Also, even slight odors makes bleaching compositions unsuitable for "mini-labs" that may be situated in malls or large stores.

All of the bleaching compositions actually demonstrated in U.S. Pat. No. 5,061,608 (noted above) contain acetic acid. No succinic acid formulations are demonstrated. In U.S. Pat. No. 5,352,568 (noted above), quite a number of acidic compounds are demonstrated in bleaching solutions, including succinic acid. However, no formulation procedure is described except that the acid is merely added to an aqueous solution already containing the other components, and water was added to provide 1 liter of solution.

One commercially available bleaching solution includes glacial acetic acid, ammonium bromide, 1,3-propylenediaminetetraacetic acid, 1,3-diaminopropanol tetraacetic acid, ammonia and ferric nitrate, and has a pH of about 3.6.

When succinic acid was used in place of glacial acetic acid in this solution, and common formulation procedures were used, extensive precipitates were formed. Such precipitates are believed to be ferric oxide and ferric succinate. The propensity of ferric ion to form a complex with succinic acid compared to forming a complex with acetic acid is at least 1000 times greater.

There is a need in the art for bleaching and bleach-fixing compositions containing succinic acid, maleic acid or malic acid, which compositions are ready to use after being prepared in scaled up quantities without significant precipitates.

SUMMARY OF THE INVENTION

The present invention provides a method for preparing a ready to use photographic bleaching solution having a final pH of from 2.5 to 5.5, and comprising the steps of, in order:

A) preparing an aqueous solution of succinic acid, maleic acid or malic acid, and an aminopolycarboxylic acid ligand, B) adding a ferric salt to the aqueous solution, and C) adding a chemical base to the aqueous solution in an amount sufficient to raise the solution pH to the final pH, and to provide a molar ratio of the chemical base to the ligand of from 3.5:1 to 8.5:1,, the chemical base being added to the aqueous solution in either one or two portions, provided that when it is added in two portions, a first portion is added before step B, and a second portion is added immediately after step B, and further provided that the weight ratio of the second portion to the first portion is at least 2:1.

This invention also provides a bleaching solution prepared in this manner. It has been found that succinic acid cannot readily be substituted for acetic acid in bleaching solutions when the solutions are prepared in large industrial quantities in a conventional fashion. Simply substituting succinic acid for acetic acid in industrial quantities of bleaching solutions produced considerable precipitates and thus, useless solutions. It was with considerable effort that a specific formulation procedure of this invention was found that allows a ready-to-use bleaching solution to be prepared with succinic acid, maleic acid or malic acid as one of the necessary components. While the prior art cited above describes the use of succinic acid, maleic acid or malic acid in bleaching solutions, it fails to teach how the formulations can be prepared on a large scale. On small laboratory scale, when succinic acid is substituted for acetic acid, minor precipitates that may be formed may be ignored or easily filtered, but that is not possible with large amounts of precipitates. The present invention overcomes these problems.

DETAILED DESCRIPTION OF THE INVENTION

The present invention is a means for providing a ready-to-use photographic bleaching solution on an industrial scale (that is, large quantities) in a reproducible manner. "Bleaching solutions" are meant to include bleach-fixing solutions containing a photographic fixing agent as well as a photographic bleaching agent.

The bleaching solution of this invention has a final pH of from 2.5 to about 5.5, and preferably of from 3.5 to 4.5. These pH limits are generally necessary for bleaching performance in processing photographic materials.

In the first step of this invention, an aqueous solution of succinic acid, maleic acid or malic acid, and one or more aminopolycarboxylic acid ligands is prepared. This can be done by adding the components to water, or water to them, in any suitable order. Preferably, the succinic acid, maleic acid or malic acid is mixed in water first, followed by mixing in the one or more aminopolycarboxylic acid ligands. Succinic acid, maleic acid or malic acid can be used as a free acid or as a suitable alkali metal (such as sodium or potassium) or ammonium salt.

The amount of succinic acid, maleic acid or malic acid organic buffer used in the practice of this invention is sufficient to provide at least about 0.35 mol/l and preferably from about 0.75 to about 1.25 mol/l in the final solution. Succinic acid is the preferred organic buffer.

The amount of one or more aminopolycarboxylic acid ligands (or a salt thereof) is generally at least about 1.1 times (molar basis) the level of ferric ion (defined below).

A wide variety of aminopolycarboxylic acid ligands can be used in the practice of this invention, individually or in mixtures, to form ferric bleaching complexes. Representative ligands are described in U.S. Pat. No. 5,061,608 (noted above), U.S. Pat. No. 5,352,568 (noted above), U.S. Pat. No. 5,236,814 (Kuse et al), U.S. Pat. No. 5,250,401 (Okada et al), U.S. Pat. No. 5,250,402 (Okada et al), EP-A-0 475,768 (Kuse et al), EP-A-0 556 782 (Yamashita et al) and EP-A-0 567 126 (Seki et al), all incorporated herein by reference.

Ligands useful in this invention are polycarboxylate or aminocarboxylate ligands which are well known in the art and include compounds having at least two carboxyl groups (polydentate), or their corresponding salts. Such ligands can be bidentate, tridentate, tetradentate, pentadentate and hexadentate ligands, referring to the number of sites available to bind to ferric ion. These ligands must be water-soluble also, and are preferably biodegradable (defined below).

More specifically, such ligands include, but are not limited to, hydroxycarboxylic acids, alkylenediaminetetracarboxylic acids having a tertiary nitrogen atom, alkylenediaminepolycarboxylic acids having a secondary nitrogen atom, iminopolyacetic acids, substituted ethyliminopolycarboxylic acids, aminopolycarboxylic acids having an aliphatic dibasic acid group and amino ligands having an aromatic or heterocyclic substituent.

Representative useful classes of such ligands are defined below in reference to structures (I)–(VII), although it should be recognized that the invention is not limited in practice to these ligands.

Thus, useful ligands can be compounds having any of the following structures:

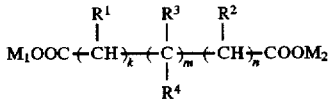

(I)

wherein $R^1$ and $R^2$ are independently hydrogen or hydroxy, $R^3$ and $R^4$ are independently hydrogen, hydroxy or carboxy (or a corresponding salt), $M_1$ and $M_2$ are independently hydrogen or a monovalent cation (such as ammonium, sodium, potassium or lithium), k, m and n are 0 or 1, provided that at least one of k, m and n is 1, and further provided that compound (I) has at least one hydroxy group.

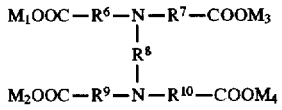

(II)

wherein $R^6$, $R^7$, $R^8$, $R^9$ and $R^{10}$ are independently a linear or branched substituted or unsubstituted alkylene group of 1 to 8 carbon atoms (such as methylene, ethylene, trimethylene, hexamethylene, 2-methyltrimethylene and 4-ethylhexamethylene), and $M_1$, $M_2$, $M_3$ and $M_4$ are independently hydrogen or a monovalent cation, as defined above for $M_1$ and $M_2$.

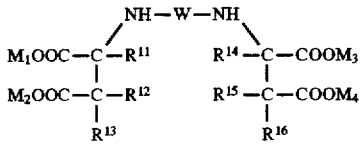

wherein $R^{11}$, $R^{12}$, $R^{13}$, $R^{14}$, $R^{15}$ and $R^{16}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), $M_1$, $M_2$, $M_3$ and $M_4$ are as defined above, and W is a covalent bond or a divalent substituted or unsubstituted aliphatic linking group (defined below),

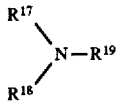

(IV)

wherein at least two of $R^{17}$, $R^{18}$ and $R^{19}$ are a carboxymethyl (or equivalent salts), and the third group is hydrogen, a substituted or unsubstituted alkyl group of 1 to 5 carbon atoms (as defined above), a substituted or unsubstituted hydroxyethyl or unsubstituted carboxymethyl (or equivalent salts),

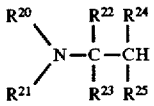

(V)

wherein $R^{20}$ and $R^{21}$ are independently substituted or unsubstituted carboxymethyl (or equivalent salts) or 2-carboxyethyl (or equivalent salts), and $R^{22}$, $R^{23}$, $R^{24}$ and $R^{25}$ are independently hydrogen, a substituted or unsubstituted alkyl group of 1 to 5 carbon atoms (as defined above), hydroxy, carboxy, carboxymethylamino, or substituted or unsubstituted carboxymethyl (or equivalent salts), provided that only one of $R^{22}$, $R^{23}$, $R^{24}$ and $R^{25}$ is carboxy, carboxymethylamino, or substituted or unsubstituted carboxymethyl (or equivalent salts).

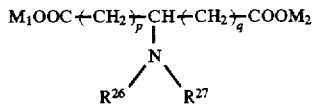

wherein $R^{26}$ and $R^{27}$ are independently hydrogen, a substituted or unsubstituted alkyl group of 1 to 5 carbon atoms (as defined above), substituted or unsubstituted hydroxyethyl, substituted or unsubstituted carboxymethyl or 2-carboxyethyl (or equivalent salts), $M_1$ and $M_2$ are as defined above, and p and q are independently 0, 1 or 2 provided that the sum of p and q does not exceed 2, or

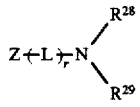

(VII)

wherein

Z represents a substituted or unsubstituted aryl group of 6 to 10 carbon atoms in the nucleus (as defined above) or a substituted or unsubstituted heterocycle having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, piperidinyl, pyrazinyl, triazinyl, oxazinyl, azepinyl, oxepinyl and thiapinyl), L is a divalent substituted or unsubstituted aliphatic linking group (defined below), $R^{28}$ and $R^{29}$ are independently hydrogen, a substituted or unsubstituted alkyl group of 1 to 5 carbon atoms (as defined above), a substituted or unsubstituted carboxyalkyl group of 2 to 4 carbon atoms (such as substituted or unsubstituted carboxymethyl or carboxyethyl or equivalent salts) or a hydroxy-substituted carboxyalkyl group of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups which form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others which would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, carboxy, sulfo, sulfonato, thioalkyl, alkylcarbonamido, alkylcarbamoyl, alkylsulfonamido, alkylsulfamoyl, carbonamido, sulfonamido, sulfamoyl, amino, halo (such as chloro or bromo), sulfono (—$SO_2R$) or sulfoxo [—S(O)R] wherein R is a branched or linear alkyl group of 1 to 5 carbon atoms.

In reference to the foregoing structures (I)–(VII), preferred definitions of groups are as follows:

$R^1$ and $R^2$ are independently hydrogen or hydroxy, $R^3$ and $R^4$ are independently hydroxy or carboxy, provided at least one hydroxy group is in compound (I), $R^6$, $R^7$, $R^8$, $R^9$ and $R^{10}$ are independently a substituted or unsubstituted alkylene group of 1 to 3 carbon atoms, $M_1$, $M_2$, $M_3$ and $M_4$ are independently hydrogen, ammonium, sodium or potassium, $R_{11}$, $R^{12}$, $R^{13}$, $R^{14}$, $R^{15}$ and $R^{16}$ are independently hydrogen, hydroxy or methyl, W is a covalent bond or a substituted or unsubstituted alkylene group of 1 to 3 carbon atoms, at least two of $R^{17}$, $R^{18}$ and $R^{19}$ are carboxymethyl and the third group is hydrogen, methyl, carboxymethyl or carboxyethyl, $R^{20}$ and $R^{21}$ are each carboxymethyl, $R^{22}$, $R^{23}$, $R^{24}$ and $R^{25}$ are independently hydrogen, carboxymethyl or carboxy, $R^{26}$ and $R^{27}$ are independently hydrogen, methyl or carboxymethyl, Z represents 2-pyridyl or 2-imidazolyl, L is substituted or unsubstituted alkylene of 1 to 3 carbon atoms, $R^{28}$ and $R^{29}$ are independently hydrogen, 2-carboxyethyl or carboxymethyl, and r is 1.

Representative ligands are citric acid, tartaric acid, iminodiacetic acid, methyliminodiacetic acid, nitrilotriacetic acid, β-alaninediacetic acid, alaninediacetic acid, ethylenediaminedisuccinic acid, ethylenediaminediacetic acid, alaninedipropionic acid, isoserinediacetic acid, serinediacetic acid, ethylenediaminetetraacetic acid, iminodisuccinic acid, aspartic acid monoacetic acid, aspartic acid diacetic acid, aspartic acid dipropionic acid, 2-hydroxybenzyliminodiacetic acid and 2-pyridylmethyliminodiacetic acid, 1,3-propylenediaminetetraacetic acid, and ethylenediaminemonosuccinic acid.

Other useful ligands include substituted or unsubstituted 2-pyridinecarboxylic acids and substituted or unsubstituted 2,6-pyridinedicarboxylic acids (or equivalent salts). The substituents which may be on the pyridinyl ring include substituted or substituted alkyl, substituted or unsubstituted cycloalkyl or substituted or unsubstituted aryl groups (as defined above for structures I–VII), hydroxy, nitro, sulfo, amino, carboxy, sulfamoyl, sulfonamide, phospho, halo or any other group that does not interfere with ferric ion ternary complex formation, stability, solubility or catalytic activity. The substituents can also be the atoms necessary to form a 5- to 7-membered fused ring between any of the positions of the pyridinyl nucleus.

The preferred ligands of this type are represented by the following structures:

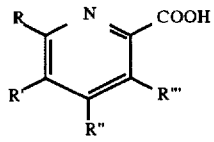

(VIII)

and

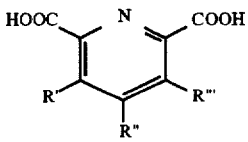

(IX)

wherein

R, R', R" and R'" are independently hydrogen, a substituted or unsubstituted alkyl group of 1 to 5 carbon atoms (as defined above), a substituted or unsubstituted aryl group of 6 to 10 carbon atoms (as defined above), a substituted or unsubstituted cycloalkyl group of 5 to 10 carbon atoms (as defined above), hydroxy, nitro, sulfo, amino, carboxy, sulfamoyl, sulfonamido, phospho or halo (such as chloro or bromo), or any two of R, R', R" and R'" can comprise the carbon atoms necessary to form a substituted or unsubstituted 5 to 7-membered ring fused with the pyridinyl nucleus.

The monovalent and divalent radicals defining Structures VIII and IX can have substituents like those defining the radicals for Structures I–VII above.

Preferably, R, R', R" and R'" are independently hydrogen, hydroxy or carboxy. The most preferred compounds are unsubstituted 2-pyridinecarboxylic acid and 2,6-pyridinedicarboxylic acid.

Preferred aminopolycarboxylic acid ligands in the practice of this invention include: ethylenediaminetetraacetic acid, ethylenediamine-N-N'-disuccinic acid, ethylenediaminemonosuccinic acid, methyliminodiacetic acid and 1,3-propylenediaminetetraacetic acid. A mixture of two or more of these compounds may be useful.

After preparing the aqueous solution containing succinic acid, maleic acid or malic acid, and one or more aminopolycarboxylic acid ligands, a ferric salt is added in sufficient quantities to complex with the ligand(s). Useful ferric salts include, but are not limited to, ferric nitrate, ferric bromide, ferric chloride and ferric oxide. Ferric nitrate is preferred.

Generally, the amount of ferric salt included is sufficient to provide ferric ion at a concentration of at least 0.1 mol/l in the final bleaching solution. The salt is generally added in the form of an aqueous solution for easy mixing.

Immediately after addition of the ferric salt, or both before and after this addition of ferric salt, a chemical base is added to the aqueous solution in an amount sufficient to raise the pH of the solution to a final pH of from 2.5 to 5.5 (preferably, from 3.5 to 4.5). Thus, the chemical base can be added in first and second portions, one portion being added sometime before the ferric salt addition, and the second portion of chemical base being added immediately afterwards. Alternatively, all of the chemical base can be added immediately after the ferric salt addition.

The rate of addition of the ferric salt may affect the amount of chemical base added in the first portion. For example, the slower the rate of addition, the less chemical base needs to be added in a first portion to keep the solution free of precipitates.

As used herein, a "chemical base" is an organic or inorganic compound that dissociates in water to accept a proton. Useful chemical bases added in the practice of this invention include, but are not limited to, ammonia and hydroxides (such as sodium hydroxide and potassium hydroxide). Ammonia is preferred.

The added chemical base not only raises the solution pH to the final pH, but is added in sufficient amounts so that it is present in a molar ratio to the aminopolycarboxylic acid ligand of from 3.5:1 to 8.5:1. Preferably, this molar ratio of chemical base to ligand is from 4:1 to 6:1.

When the chemical base is added in two portions, the weight ratio of the second portion (added after the ferric salt) to the first portion is at least 2:1. A weight ratio of from 2:1 to 10:1 is preferred, and a weight ratio of from about 6:1 to 8:1 is more preferred. The amount of base added in the first portion can be as much as 0.8 mol (for example, about 50 g of ammonia).

In a preferred embodiment, a halide ion is mixed into the aqueous solution after all of the chemical base has been added. The amount of halide ion added is conventional in the art, that is from about 0.25 to about 1.25 mol/l. Bromide ion is the preferred halide ion, and is present in an amount of from about 0.5 to about 1.25 mol/l in the final bleaching solution.

In one embodiment of this invention, a method for preparing a ready-to-use photographic bleaching solution having a final pH of from 3.5 to 4.5, comprises the steps of, in order:

A) preparing an aqueous solution of succinic acid, maleic acid or malic acid, and one or more aminopolycarboxylic acid ligands, B) adding a first portion of a chemical base to the aqueous solution, C) adding a ferric salt to the aqueous solution, and D) adding a second portion of the chemical base to the aqueous solution in an amount sufficient to raise the solution pH to the final pH, and to provide a molar ratio of the chemical base to the ligand of from 4:1 to 6:1, wherein the weight ratio of the second portion to the first portion is from 2:1 to 10:1.

In a preferred embodiment, a method for preparing a ready-to-use photographic bleaching solution having a final pH of from 3.5 to 4.5, comprises the steps of, in order:

A) preparing an aqueous solution of succinic acid, maleic acid or malic acid, and one or more aminopolycarboxylic acid ligands, B) adding a ferric salt to the aqueous solution, C) adding a single portion of a chemical base to the aqueous solution in an amount sufficient to raise the solution pH to the final pH, and to provide a molar ratio of the chemical base to the ligand of from 4:1 to 6:1.

The bleaching solutions prepared according to this invention can also include conventional components such as sequestering agents, sulfites, buffers, and non-chelated salts of aminopolycarboxylic acid ligands, in conventional amounts. These components can be added at any suitable point in the preparatory method, but preferably, they are mixed with the succinic acid, maleic acid or malic acid, and aminopolycarboxylic acid ligand(s) prior to addition of the ferric salt and chemical base. It is particularly useful to add a sequestering agent immediately after mixing the succinic acid, maleic acid or malic acid, and the aminopolycarboxylic acid ligand in the aqueous solution, and prior to addition of any other components. One useful sequestering agent is 1,3-diaminopropanoltetraacetic acid.

It is also preferred that steps B and C (and D if used) of the present invention be carried out under high agitation because the solution at this point may in the form of a slurry or dispersion, so the high agitation keeps the components properly mixed, and enables proper mixing of newly added components, such as the chemical base.

The bleaching solutions prepared according to the present invention can be used as concentrates, diluted working strength solutions or bleaching solution replenishers.

The components of the bleaching solutions described herein are generally available from a number of commercial sources.

The following example demonstrates the practice of this invention. All percentages are by weight unless otherwise indicated.

EXAMPLE 1

Bleaching Formulation Comparisons

Several bleaching solutions were prepared using various formulation procedures to see if succinic acid could be readily used in place of acetic acid.

In Formulation A (Comparison), succinic acid was directly substituted for glacial acetic acid in a commercial bleaching solution that was mixed in the following order:

| | | |
|---|---|---|
| Step 1: | Water | 398.8 g |
| Step 2: | 1,3-Propylenediamine-tetraacetic acid | 138.8 g |
| Step 3: | Succinic acid | 120.0 g |
| Step 4: | 1,3-Diaminopropanol tetraacetic acid | 1.2 g |
| Step 5: | Ammonia (28%) | 150.4 g |
| Step 6: | Ferric nitrate (35%) | 284.8 g |

The resulting bleaching solution from Formulation A contained considerable precipitates, and was therefore not useful.

Formulation B (Comparison) was prepared in the following order:

| | | |
|---|---|---|
| Step 1: | Water | 398.8 g |
| Step 2: | Ammonia (28%) | 150.4 g |
| Step 3: | Succinic acid | 120.0 g |
| Step 4: | 1,3-Propylenediamine-tetraacetic acid | 138.8 g |
| Step 5: | 1,3-diaminopropanol tetraacetic acid | 1.2 g |
| Step 6: | Ferric nitrate (35%) | 284.8 g |
| Step 7: | Ammonium bromide | 115.7 g |

The resulting bleaching solution of Formulation B also contained considerable precipitates and was therefore not useful.

Formulation C (Comparison) was prepared using the following steps:

| | | |
|---|---|---|
| Step 1: | Water | 398.8 g |
| Step 2: | 1,3-Propylenediamine-tetraacetic acid | 138.8 g |
| Step 3: | Ammonia (28%) | 150.4 g |
| Step 4: | 1,3-Diaminopropanol tetraacetic acid | 1.2 g |
| Step 5: | Ammonium bromide | 115.7 g |
| Step 6: | Ferric nitrate (35%) | 284.8 g |
| Step 7: | Succinic acid | 120.0 g |

The resulting bleaching solution from Formulation C also contained considerable precipitates and was therefore not useful.

Formulation D (Comparison) was prepared in the following order to form two "parts" that were then mixed:

| | | |
|---|---|---|
| Part A: | | |
| Step 1: | Water | 398.8 g |
| Step 2: | Ammonia (28%) | 65.0 g |
| Step 3: | Succinic acid | 120.0 g |
| Part B: | | |
| Step 1: | Water | 286.1 g |
| Step 2: | Ammonia (28%) | 45.0 g |
| Step 3: | 1,3-Propylenediamine-diaminetetraacetic acid | 138.8 g |
| Step 4: | 1,3-Diaminopropanol tetraacetic acid | 1.2 g |
| Step 5: | Ferric nitrate (35%) | 142.4 g |
| Step 6: | Ammonia (28%) | 39.4 g |
| Step 7: | Ferric nitrate (35%) | 142.4 g |
| Step 8: | Mix with Part A | |

The bleaching solution resulting from Formulation D also contained considerable precipitates and was therefore not useful.

Formulation E (Invention) was successfully prepared without any precipitates using the following order:

| | | |
|---|---|---|
| Step 1: | Water | 398.8 g |
| Step 2: | Succinic acid | 120.0 g |
| Step 3: | 1,3-Propylenediamine-tetraacetic acid | 138.8 g |
| Step 4: | 1,3-Diaminopropanol tetraacetic acid | 1.2 g |
| Step 5: | Ammonia (28%) | 20.0 g |
| Step 6: | Ferric nitrate (35%) | 284.8 g |
| Step 7: | Ammonia (28%) | 130.4 g |
| Step 8: | Ammonium bromide | 115.7 g |

The resulting bleaching solution had a final pH of 4.0, and was free of precipitates. The pH of the solution after Step 4 (and before Step 5) was less than 2. The amount of ammonia added in the "first portion" of chemical base in Step 5 was adjusted to keep precipitates from forming at that stage of the formulation, and the amount of ammonia added in Step 7 was then adjusted to bring the final pH to the desired value.

EXAMPLE 2

Preferred Formulation Method

A preferred method of this invention was successfully used to prepare a bleaching solution without any precipitates using the following mixing steps:

| | | |
|---|---|---|
| Step 1: | Water | 463.0 g |
| Step 2: | Succinic acid | 97.6 g |
| Step 3: | 1,3-Propylenediamine-tetraacetic acid | 132.6 g |
| Step 4: | 1,3-Diaminopropanol tetraacetic acid | 1.2 g |
| Step 5: | Ferric nitrate (35%) | 271.8 g |
| Step 7: | Ammonia (28%) | 136.3 g |
| Step 8: | Ammonium bromide | 73.2 g |

The resulting bleaching solution had a final pH of 4.0, and was free of precipitates. In this formulation, the chemical base (ammonia) was added in a single portion after addition of the ferric salt.

EXAMPLE 3

Alternative Formulations Using Maleic Acid and Malic Acid

The present invention was used to prepare bleaching solutions without precipitate formation using maleic acid or malic acid as the organic buffer in the place of acetic acid. The formulations were prepared using the following mixing steps:

| | | |
|---|---|---|
| Step 1: | Water | 398.8 g |
| Step 2: | Malic or maleic acid | 136.3 or 118.0 g |
| Step 3: | 1,3-Propylenediamine tetraacetic acid | 138.8 g |
| Step 4: | 1,3-Diaminopropanol tetraacetic acid | 1.2 g |
| Step 5: | Ferric nitrate (35%) | 284.8 g |
| Step 7: | Ammonia (28%) | 170.0 or 180.0 g |
| Step 8: | Ammonium bromide | 115.7 g |

The invention has been described in detail with particular reference to preferred embodiments thereof, but it will be understood that variations and modifications can be effected within the spirit and scope of the invention.

We claim:

1. A method for preparing a ready to use photographic bleaching solution having a final pH of from 2.5 to 5.5, and comprising the steps of, in order:

A) preparing an aqueous solution of succinic acid, maleic acid or malic acid to provide at least 0.35 mol/l of said acid in the final solution, and an aminopolycarboxylic acid ligand, B) adding a ferric salt to said aqueous solution to provide at least 0.1 mol/l of ferric ion in the final solution, the molar ratio of said ligand to ferric ion in the final solution being at least 1.1:1, and C) adding a chemical base to said aqueous solution in an amount sufficient to raise the pH to said final pH, and to provide a molar ratio of said chemical base to said ligand of from 4:1 to 8.5:1, said chemical base being added to said aqueous solution in either one or two portions, provided that when it is added in two portions, a first portion is added before step B, and a second portion is added immediately after step B, and further provided that the weight ratio of said second portion to said first portion is at least 2:1.

2. A photographic bleaching solution prepared by the method of claim 1.

3. A method for preparing a ready to use photographic bleaching solution having a final pH of from 3.5 to 4.5, and comprising the steps of, in order:

A) preparing an aqueous solution of succinic acid, maleic acid or malic acid to provide at least 0.35 mol/l of said acid in the final solution, and one or more aminopolycarboxylic acid ligands, and B) adding a ferric salt to said aqueous solution to provide at least 0.1 mol/l of ferric ion in the final solution, the molar ratio of said one or more ligands to ferric ion in the final solution being at least 1.1:1, C) adding a single portion of a chemical base to said aqueous solution in an amount sufficient to raise the pH to said final pH, and to provide a molar ratio of said chemical base to said one or more ligands of from 4:1 to 6:1.

4. A photographic bleaching solution prepared by the method of claim 3.

5. The method of claim 1 wherein said chemical base is added to said aqueous solution in a single portion in step C.

6. The method of claim 1 wherein said chemical base is added to said aqueous solution in first and second portions, and the weight ratio of said second portion to said first portion is from 2:1 to 10:1.

7. The method of claim 1 wherein a halide ion is added to said aqueous solution after the addition of all of said chemical base.

8. The method of claim 7 wherein said added halide ion is bromide ion.

9. The method of claim 1 wherein said final pH is from 3.5 to 4.5.

10. The method of claim 1 wherein a sequestering agent is added to the aqueous solution formed in step A.

11. The method of claim 1 wherein said ferric salt is ferric nitrate.

12. The method of claim 1 wherein said aminopolycarboxylic acid ligand is 1,3-propylenediamine-tetraacetic acid, ethylenediaminetetraacetic acid, ethylenediamine-N-N'-disuccinic acid, ethylenediaminemonosuccinic acid, or methyliminodiacetic acid, or mixtures thereof.

13. The method of claim 1 wherein steps B and C are carried out under high agitation.

14. The method of claim 1 wherein said aminopolycarboxylic acid ligand is mixed with succinic acid.

15. The method of claim 3 wherein said aminopolycarboxylic acid ligand is 1,3-propylenediaminetetraacetic acid, and said ferric salt is ferric nitrate, and wherein a sequestering agent is added to the aqueous solution formed in step A, and bromide ion is added after the addition of said chemical base.

16. The method of claim 3 wherein steps B and C are carried out under high agitation.

17. The method of claim 3 wherein succinic acid is mixed in step A.

18. The method of claim 17 wherein step A is carried out by mixing in water, in order, succinic acid, maleic acid or malic acid, and said aminopolycarboxylic acid ligand.

19. The method of claim 18 wherein a sequestering agent is added to the aqueous solution formed in step A after the mixing of said aminopolycarboxylic acid ligand with succinic acid, maleic acid or malic acid.

20. The method of claim 3 wherein two or more of aminopolycarboxylic acid ligands are mixed with succinic acid.

* * * * *